United States Patent [19]

Bible

[11] Patent Number: 4,779,360

[45] Date of Patent: Oct. 25, 1988

[54] SHOE ATTACHMENT TO REDUCE INNER AND OUTER SKIDDING

[76] Inventor: George R. Bible, 1412 Bedlleville Ave., Maryville, Tenn. 37801

[21] Appl. No.: 59,023

[22] Filed: Jun. 8, 1987

[51] Int. Cl.[4] ..... A43B 13/22; A43B 13/26

[52] U.S. Cl. ..... 36/7.7; 36/59 R

[58] Field of Search ..... 36/7.1, 7.3, 7.6, 7.7, 36/15, 30 R, 30 A, 59 R, 59 A, 59 B, 59 C, 62, 75 R, 98, 113, 124, 21, 23, 26

[56] References Cited

U.S. PATENT DOCUMENTS

| | | | |
|---|---|---|---|
| 90,118 | 5/1869 | Osgood | 36/59 R |
| 2,084,784 | 6/1937 | Stahl | 36/59 B X |
| 2,628,437 | 2/1953 | Forsythe | 36/7.7 |
| 3,573,155 | 3/1971 | Mitchell | 36/59 R X |
| 4,160,331 | 7/1979 | Bell | 36/59 B |
| 4,246,707 | 1/1981 | Pedersen | 36/59 R X |

*Primary Examiner*—Donald Watkins

*Attorney, Agent, or Firm*—Pitts and Brittian

[57] ABSTRACT

A shoe attachment (10) for being releasably mounted on a shoe (16), boot or the like to prevent inner and outer skidding is disclosed. The attachment (10) comprises a body (12) having an upper (14) which is releasably mounted on the lower portion of the shoe (16). This upper (14), in the preferred embodiment, terminates in a sole (22) which defines, with the upper, the cavity which receives the shoe (16). The sole (22) is fabricated such that skidding is reduced between the attachment sole (22) and the supporting surface (26) and between the attachment sole (22) and the shoe sole (22) received within the attachment cavity.

20 Claims, 2 Drawing Sheets

SHOE ATTACHMENT TO REDUCE INNER AND OUTER SKIDDING

DESCRIPTION

1. Technical Field

This invention relates to a shoe attachment to prevent skidding between both the shoe and the attachment sole and between the attachment sole and a supporting surface.

2. Background Art

Footwear designed to assist in preventing skidding between a shoe and a supporting surface is well known. Conventionally, such footwear includes a pad or other attachment which is mounted proximate the sole of the shoe and which is designed to increase the friction between the shoe and a slick supporting surface. Known devices assume various configurations and are designed in certain embodiments to cover the entire sole of the shoe, and certain other embodiments are designed for half sole coverage. Further, the particular means for increasing the frictional engagement between the shoe sole and the slippery supporting surface varies. For example, certain known devices include the spring biased plungers or spikes. Other devices simply include improved tread mechanisms which are attached to the shoe to increase the frictional engagement between the shoe sole and the supporting surface. These and other known devices are included in the following U.S. Pat. Nos.: 2,155,979; 2,170,691; 2,189,489; 2,193,943; 2,258,322; 2,300,091; 3,616,552; 4,299,037; 4,372,056; and 4,434,565.

It is an object of the present invention to provide an improved shoe attachment which assists in preventing both inner slippage between the shoe sole and the attachment sole, and outer slippage between the shoe attachment and the supporting surface. Another object of the present invention is to provide an inexpensive shoe attachment to prevent skidding which can be readily mounted proximate the sole of a shoe. Yet another object of the present invention is to provide such an attachment which is light weight and disposable.

DISCLOSURE OF THE INVENTION

Other objects and advantages will be accomplished by the present invention which provides a shoe attachment to reduce both inner and outer skidding. The shoe attachment of the present invention comprises a body having an upper which is releasably mounted on at least a lower portion of a shoe, boot or the like. This upper preferably terminates the sole which is connected to the upper proximate is lower portion. The sole and the upper define a cavity for releasably receiving a shoe, boot or the like. The attachment sole is designated to include, in the preferred embodiment, a plurality of particles bonded therein which protrude in a manner to assist in preventing skidding or rolling which may occur between the sole of a shoe and the attachment. Certain of these particles further protrude in a manner to assist in preventing skidding which may occur between the supporting surface and the attachment itself. In one embodiment, the sole is provided with a homogeneous mixture of particles which are bonded in the sole material such that they extend both outwardly and inwardly to reduce the above described skidding which can occur between the attachment and the shoe sole of the supporting surface.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

Figure 1:
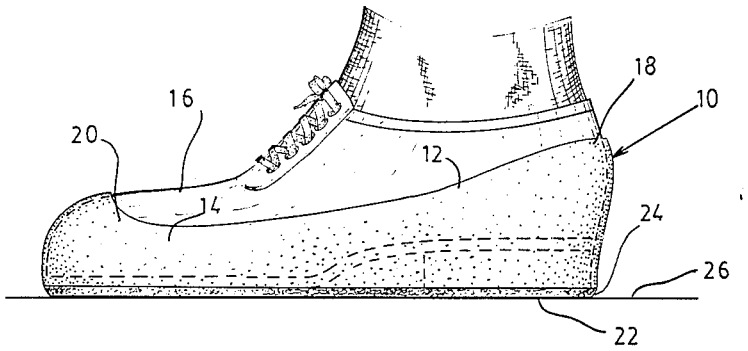
FIG. 1 illustrates a side elevational view of a shoe attachment constructed in accordance with various features of the present invention as it is mounted on a shoe and ready for use.

A shoe attachment incorporating various features of the invention is illustrated generally at 10 in the figures. The attachment includes a body 12 having an upper 14 which is releasably mounted on at least a lower portion of the shoe 16. This upper is preferably fabricated from a suitable rubber or other stretchable material which is designed to releasably receive the shoe therein. More specifically, the upper 14 includes a heel portion 18 and a toe portion 20 which are designed for releasably receiving the heel and toe portions, respectively, of the shoe 16.

A sole 22 is connected to the upper 14 proximate its lower portion 24 as is shown in FIG. 1. This sole combines with the upper portion 14 of the body 12 to define a cavity for releasably receiving the shoe 16 therein. An important feature of the present invention is the provision of sole means 22 which prevents inner skid or roll, i.e., skidding between the inner surface of the attachment sole 22 and the sole of the shoe 16. Another important feature of the present invention is to provide a sole means 22 which serves to prevent outer skidding, i.e. skidding between the outer attachment sole 22 and the supporting surface 26.

Figure 2:
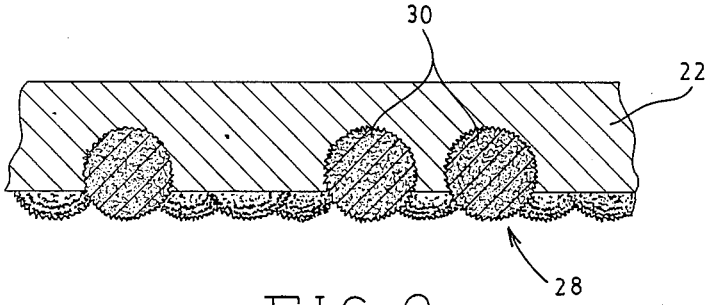
FIG. 2 illustrates a sectional view of a portion of a non-skid sole constructed in accordance with various features of the present invention.

Referring first to the outer anti-skid feature, the outer anti-skid means is generally indicated at 28 in FIG. 2. In the preferred embodiment shown in FIG. 2, the sole 22 is fabricated from rubber impregnated with granular particles 30. It has been found that a homogeneous mixture of particles 30 serve to provide adequate anti-skidding forces particularly if the particles are fabricated from aluminum oxide, silicon carbide and/or tungston carbide. These particular particles in granular form are preferred since they are durable, have less tendencies to crumble and are of a hardness sufficient to scratch or furrow up in a metallic slippery surface particularly where the external surface of the particles have an irregular configuration as is illustrated in FIG. 2.

These particles are bonded into the sole 26 which in one embodiment comprises 40–50 durometer rubber. In one particular embodiment, the rubber had a thickness of $\frac{1}{8}$ inch and the mean diameter of the particles was approximately ⅛ inch such that the embedded particles extended proximately 1/32 of an inch outside of the rubber sole material and 3/32 of an inch inside of the rubber sole material. This enhanced the bonding between the rubber of the sole 22 and allowed the harder particles to be held within the rubber sole since they were substantially surrounded (as much as 66% of the surface area of the particles was contained within the sole) by the rubber and did not tend to be released therefrom when the rubber sole was stretched. In such an embodiment, as the body weight is applied to the sole the particles extending in the cavity receiving the shoe will retract and be forced in a downward direction. Particles extending outwardly from the sole in contacting the supporting surface 26 will also be forced downwardly and bite into the surface being walked on. This will enhance the attachment's ability to prevent skidding both between the attachment sole and the shoe sole (inner skidding) and between the attachment sole and the supporting surface (outer skidding).

Figure 3:
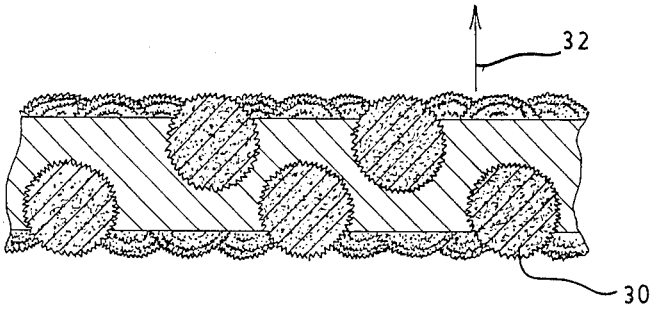
FIG. 3 illustrates an alternate embodiment of a section of an attachment constructed in accordance with various features of the present invention which incorporate non-skid particles bonded within the sole and protruding in a manner such that they engage both the supporting surface and the sole of a shoe.

FIG. 3 illustrates an embodiment in which the particles 30 extend outwardly towards the supporting surface and serve as an outer anti-skid means 28. It will also be noted that certain of the particles extend inwardly in a direction of the arrow 32 and serve to define inner anti-skidding means between the inner surface of the sole 22 and the sole of the shoe 16.

Figure 4:
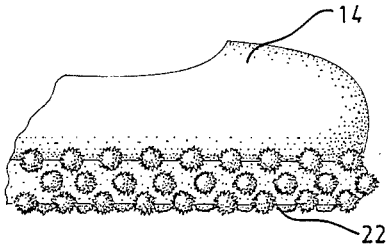
FIG. 4 illustrates an alternate construction of a shoe attachment in which the improved sole is bonded to the lower edge portions of the upper to define the cavity for receiving the shoe.

FIG. 4 illustrates an alternate construction of an attachment 10 incorporating features of the invention. In this embodiment, a sole such as the sole 22 shown in FIG. 3 is bonded around the perimeter of the upper 14. In this embodiment, the upper 14 is first fabricated having an inwardly turned lower portion which defines an opening to which the sole 22 shown in FIG. 4 is bonded to cover the lower portion of the upper 14 and define a cavity for receiving the shoe 16.

Figure 5:
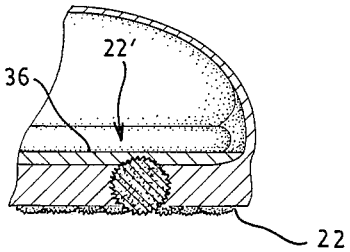

A further embodiment of the present invention is shown in FIG. 5. In this embodiment, the sole 22' includes an inner sole 36 which is preferably fabricated from a non-skid material of a preselected grit. It has been found that a grit range of approximately 16–120 is acceptable depending upon application. This inner sole 36 is bonded to the sole 22 such that the sole means 22' includes both the inner sole and the sole 22. In the embodiment depicted in FIG. 5, the particles 30 are designed such that they protrude both inwardly and outwardly from the sole 22 and can penetrate the inner sole 36 to enhance the anti-skid forces produced between the shoe 16 and the attachment 10 when body weight is applied to the attachment.

From the foregoing detailed description, it will be recognized that the improved shoe attachment has been provided that serves to assist in preventing both inner skidding between the attachment of the shoe and outer skidding between the attachment sole and the supporting surface. In the preferred embodiment, anti-skidding features are provided by a homogeneous mixture of particles in granular form having a selected diameter being embedded in a suitable elastic material such as rubber. These particles extend from the surface of the rubber which serves as the sole in a manner such that they furrow into the supporting surface and into the sole of the shoe to prevent skidding.

While a preferred embodiment has been shown and described, it will be understood that it is not intended to limit the invention to such disclosure, but rather it is intended to cover all modifications and alternate constructions falling within the spirit and the scope of the invention as defined in the appended claims.

I claim:

1. A shoe attachment to prevent inner and outer skidding comprising:

a body having an upper for releasably receiving at least a lower portion of a shoe, boot or the like;

sole means connected to said upper proximate its lower portion whereby said body and said sole means define a cavity for releasably receiving said shoe, boot or the like;

inner anti-skid means carried by said sole means to prevent skidding between said attachment sole means and a sole of a shoe received therein, said inner anti-skid means comprising a plurality of particles having a selected diameter which are embedded in said sole means such that said particles extend partially into said cavity; and outer anti-skid means carried by said sole means to prevent skidding between said attachment sole means and a slippery supporting surface, said outer anti-skid means comprising a plurality of particles embedded in said sole means such that said particles extend, at least partially, outwardly from said sole means such that said particles engage said supporting surface as body weight is applied to said attachment.

2. The shoe attachment of claim 1 wherein said particles are homogeneously mixed in said sole means.

3. The shoe attachment of claim 1 wherein said particles comprise aluminum oxide.

4. The shoe attachment of claim 1 wherein said particles comprise silicon carbide.

5. The shoe attachment of claim 1 wherein said particles comprise tungston carbide.

6. The shoe attachment of claim 1, said particles having an average diameter approximately equal to the thickness of said sole means, whereby said particles comprising said inner anti-skid means will be forced downward and retracted into said sole means and said particles comprising said outer anti-skid means are forced downward biting into said supporting surface when body weight is applied to said attachment.

7. The shoe attachment of claim 6 wherein the volume of most of said particles is more than fifty percent embedded in (or contained within) said sole means thereby durably retaining said particles in said sole means.

8. The shoe attachment of claim 1, said particles having an average diameter which is greater than the thickness of said sole means, whereby most of said particles extend both into said cavity and outwardly from said sole means resulting in the same said particles comprising both said inner and said outer anti-skid means.

9. A shoe attachment to prevent inner and outer skidding comprising:

a body having an upper for releasably receiving at least a lower portion of a shoe, boot or the like;

sole means connected to said upper proximate its lower portion whereby said body and sid sole means define a cavity for releasably receiving said shoe, boot or the like;

inner anti-skid means carried by said sole means to prevent skidding between said attachment sole means and a sole of a shoe received therein, said inner anti-skid means comprising a plurality of particles having an average diameter which is approximately equal to the thickness of said sole means which are embedded in said sole means such that said particles extend partially into said cavity;

outer anti-skid means carried by said sole means to prevent skidding between said attachment means and a slippery supporting surface, said outer anti-skid means comprising a plurality of particles having an average diameter which is approximately equal to the thickness of said sole means which are embedded in said sole means such that said particles extend, at least partially, outwardly from said sole means; and said inner and outer anti-skid means cooperating such that said particles comprising said inner anti-skid means will be forced downward and retracted into said sole means, thereby forcing said particles comprising said outer anti-skid means downward engaging and biting into said supporting surface when body weight is applied to said attachment.

10. The shoe attachment of claim 9 wherein said particles comprise aluminum oxide.

11. The shoe attachment of claim 9 wherein said particles comprise silicon carbide.

12. The shoe attachment of claim 9 wherein said particles comprise tungston carbide.

13. The shoe attachment of claim 9 wherein the volume of most of said particles is more than fifty percent embedded in (or contained within) said sole means, thereby durably retaining said particles in said sole means.

14. The shoe attachment of claim 9 wherein said particles are homogeneously mixed in said sole means.

15. A shoe attachment to prevent inner and outer skidding comprising:

a body having an upper for releasably receiving at least a lower portion of a shoe, boot or the like;

sole means connected to said upper proximate its lower portion whereby said body and said sole means define a cavity for releasably receiving said shoe, boot or the like;

inner anti-skid means carried by said sole means to prevent skidding between said attachment sole means and a sole of a shoe received therein;

outer anti-skid means carried by said sole means to prevent skidding between said attachment means and a slippery supporting surface; and said inner and outer anti-skid means comprising a plurality of particles embedded in said sole means, said particles having an average diameter which is greater than the thickness of said sole means, whereby most of said particles extend both into said cavity and outwardly from said sole means.

16. The shoe attachment of claim 15 wherein said particles are homogeneously mixed in said sole means.

17. The shoe attachment of claim 15 wherein said particles comprise aluminum oxide.

18. The shoe attachment of claim 15 wherein said particles comprise silicon carbide.

19. The shoe attachment of claim 15 wherein said particles comprise tungsten carbide.

20. The shoe attachment of claim 15 wherein said sole means further comprises an inner sole means located between said inner anti-skid means and said cavity for protecting said shoe, boot or the like against abrasion which might be caused by said inner anti-skid means.

* * * * *